United States Patent [19]

Fischer

[11] 4,075,010

[45] Feb. 21, 1978

[54] DISPERSION STRENGTHENED FERRITIC ALLOY FOR USE IN LIQUID-METAL FAST BREEDER REACTORS (LMFBRS)

[75] Inventor: John Joseph Fischer, Suffern, N.Y.

[73] Assignee: The International Nickel Company, Inc., New York, N.Y.

[21] Appl. No.: 655,463

[22] Filed: Feb. 5, 1976

[51] Int. Cl.[2] ..... B22F 3/00

[52] U.S. Cl. ..... 75/235; 75/126 D

[58] Field of Search ..... 75/226, 206, 126 D; 29/187.5

[56] References Cited

U.S. PATENT DOCUMENTS

| | | | |
|---|---|---|---|
| 3,591,362 | 7/1971 | Benjamin | 75/0.5 A |
| 3,837,930 | 9/1974 | Cairns et al. | 29/187.5 |
| 3,852,063 | 12/1974 | Niimi et al. | 75/126 D |

OTHER PUBLICATIONS

Snykers & Hunt, *Dispersion-Strengthened Ferritic Alloys for High-Temperature Applications,* pp. 237-241.

Huet et al., Nuclear Technology, vol.24, Nov. 1974, pp. 216-224.

*Primary Examiner*—Brooks H. Hunt

*Attorney, Agent, or Firm*—Ewan C. MacQueen; Raymond J. Kenny; Miriam W. Leff

[57] ABSTRACT

A dispersion-strengthened ferritic alloy is provided which has high temperature strength and is readily fabricable at ambient temperatures and which is useful as structural elements of liquid metal fast breeder reactors.

17 Claims, No Drawings

DISPERSION STRENGTHENED FERRITIC ALLOY FOR USE IN LIQUID-METAL FAST BREEDER REACTORS (LMFBRS)

This invention relates to a dispersion-strengthened ferritic alloy which has high strength at elevated temperatures and is readily fabricable at ambient temperatures. More particularly, it concerns a ferritic alloy which is useful for liquid metal fast breeder (LMFB) reactor core assemblies.

BACKGROUND OF THE INVENTION

Certain austenitic stainless steels and ferritic alloys have properties which make them suitable for use as structural materials in LMFB reactors. Neither of the materials have been found entirely satisfactory. The austenitic stainless steels, which are currently preferred as best able to meet the strength requirements, are known to exhibit a property referred to as "swelling" when subjected to fast neutron irradiation. Also, they lose ductility and have a tendency to brittle fracture on exposure to radiation. Ferritic alloys are considerably better than the austenitic stainless steels with respect to their swelling and ductility properties, and they have the advantages of higher thermal conductivity and lower thermal expansion compared to austenitics. However, the overriding drawback to the conventional ferritic alloys is that they do not have sufficient strength in the temperature range of interest for LMFB reactors which is about 600° to 750° C. The strength required at these elevated temperatures should be preferably at least equivalent to that of 316 stainless steel. In addition, a "candidate alloy" must possess a high degree of room temperature fabricability to facilitate the production of thin walled tubing and other reactor core components. One method of strengthening ferritic steels is by precipitation hardening. It is known that titanium addition of more than 2% titanium to ferritic steel results in the precipitation of a new phase ($Fe_2Ti$) which has a strengthening effect. U.S. Pat. No. 3,719,475, for example, concerns a ferritic Fe-Cr-Ti alloy containing about 2% up to 7% titanium. According to the patent, the processing conditions to produce a suitable alloy include a thermo-mechanical treatment to produce precipitation hardening. The tensile strength shown for this material is considerably less than that for 316 stainless steel.

A number of dispersion strengthened ferritic alloys have also been investigated for LMFB reactors. Where titanium has been employed, it has been added in sufficient amounts to form a precipitation hardenable phase. For example, in ISI Special Report 151, pp. 237–241 (1974) and NUCL. TECHNOL. 24 216–224 (1974) investigations are reported on dispersion-strengthened ferritic alloys including titanium-containing materials. The publications report effects of 3.5% and 5% titanium in dispersion-strengthened ferritic alloys. The data show that with respect to high temperature strength, the dispersion-strengthened alloys containing 5% Ti are better than those containing 3.5%. Only one of the alloys containing 5% Ti exceeded the strength of 316 stainless steel at elevated temperature. Despite the good strength exhibited by this material, higher strength would be even more desirable so long as this could be achieved without undue sacrifice of ductility or fabricability.

In accordance with the present invention a ferritic alloy has been found for use in LMFB reactors which not only has the desirable properties attributable to ferritic alloys but also has high temperature mechanical strength and is readily fabricable at ambient temperatures.

In discussion of the invention below, all percentage compositions are given in weight percent.

THE INVENTION

The alloy of the present invention is a dispersion-strengthened ferritic alloy which consists essentially of, by weight, about 13% to about 25% chromium, about 0.2% to less than about 2% titanium, up to 2% molybdenum and a small but effective amount for sufficient high temperature strength up to less than about 2%, yttria, and the balance, apart from incidental elements and impurities, essentially iron.

The chromium in the alloy gives strength and oxidation resistance to the alloy and it stabilizes the ferritic structure at elevated temperatures. In general, the chromium level is about 13% to about 25%. Alloys having a chromium content of less than about 13% form austenite upon heating to temperatures greater than about 850° C, and those having a chromium level above about 25% tend to lose ductility. Preferred alloys contain about 13% to less than about 20% chromium, and preferably to less than 16%, e.g. about 14% or 15%, chromium.

Titanium and molybdenum when added in small amounts serve to improve the ductility and the oxidation resistance of the alloy. Although the action of titanium and molybdenum are not completely understood, it is believed they combine with small amounts of nitrogen and carbon that might be present, forming carbides and nitrides within the metal matrix, thus preventing grain boundary embrittlement caused by chromium carbide or nitride. In addition, the titanium and molybdenum give solid solution strengthening in iron. It has also been found that titanium helps prevent chromium volatilization during annealing of the alloy, thus preserving the benefits of chromium and/or lowering the cost to achieve the desired chromium level. A further benefit is that titanium appears to suppress the formation of porosity during the annealing stage, which is believed to be related to the volatilization of chromium.

It will be noted that in the present alloy the formation of a titanium-containing precipitation hardenable phase is not relied upon for strength. The maximum titanium content in the present alloy is up to less than 2% titanium, that is below the level at which a precipitation hardenable phase will form. In fact, little or no advantage is gained by the addition of more than about 1% or even 1.5% titanium. To insure oxidation resistance and permit high temperature annealing without occurrence of chromium volatilization and concurrent formation of porosity the minimum titanium content is about 0.2%. Advantageously, the maximum titanium content is about 1.5%. Preferably, the titanium content is about 0.5% to about 1%.

Molybdenum is not an essential component. However, since it gives both high temperature strength and ductility and increased room temperature fabricability, it is preferably present in the alloy. Accordingly, preferred alloys in accordance with the present invention contain molybdenum. A very small amount can be effective for improved high temperature strength. The preferred molybdenum range is a small but effective amount up to less than about 1% or even less than about 0.75%. In a particularly advantageous embodiment of this invention the titanium content is about 0.2% or 0.5% up to about 1.5% e.g. about 0.8 or 1%, and the molybdenum content is less than about 0.75%, e.g. about 0.2% to about 0.5%.

The principal function of the yttria is to retard recrystallization after cold or hot working. To achieve this the yttria is provided as a uniformly distributed, fine dispersion. It has long been known that the ambient and elevated temperature strength of an alloy can be raised by plastic deformation, i.e. hot or cold working. However, in conventional wrought alloys that do not contain a fine dispersion of a second phase, the strengthening provided by the plastic deformation "quickly" anneals out upon exposure to elevated temperature. This occurs principally by the migration of dislocations and subsequent recrystallization of new grains. A uniformly distributed dispersoid will prevent this recrystallization by blocking the dislocation motion. The yttria may combine with other components in the composition, such as titanium or aluminum values, e.g., to form phases such as $Y_2Ti_2O_7$ or $Y_2Al_2O_6$. Very small amounts of yttria have been found effective for improving strength. In general the yttria level may vary from a very small but effective amount up to less than about 2%. Materials containing such low yttria contents can be produced having high strength, e.g. a 100-hour stress-rupture life at 650° C of at least 40 ksi. Because of the low levels of dispersoid at which this strength can be achieved, there is no substantial sacrifice in fabricability. Advantageously, the maximum yttria content is about 1.5%, and preferably it is less than about 0.75% or even less than about 0.5%. In the present alloy system a small amount of $Y_2O_3$, e.g. about 0.25%, enables a surprisingly high level of strength to be achieved without causing embrittlement. Thus, the alloys can be fabricated readily into the desired structures. For example, they can be cold rolled to more than 70% reduction in area without annealing.

The yttria is particularly useful as a dispersoid because it does not increase the size appreciably upon exposure to high temperature and does not agglomerate. Other refractory oxides and refractory carbides, nitrides, are suitable as dispersoid materials provided they have such high temperature stability. Examples of other suitable dispersoids are thoria, ceria, and rare earth oxides, and carbides or nitrides of titanium, zirconium and hafnium. Among the less desirable materials are alumina, titania and chromium carbides since it is expected that they would increase in particle size upon high temperature exposure and therefore they would be less effective in retarding or preventing recrystallization. The function of the dispersoid as an agent to retard recrystallization at high temperature, which is crucial in the present alloys, is not as important in alloys in which precipitation hardening is relied upon for strength. Thus, in alloys in which the titanium precipitation-hardenable phase is important, the titanium content must be suitably high, but there is much more flexibility in choice of the dispersoid.

As indicated above, the present alloys consist essentially of iron, chromium, titanium and yttria. In preferred alloys molybdenum is also present. However, the alloys may contain small amounts of certain other elements which may be added intentionally or present as contaminants, provided they do not disturb the characteristics of the alloy. For example, the alloys of the present invention may contain up to about 2% each of zirconium, silicon, tantalum, vanadium, tungsten and niobium. The zirconium and silicon tend to serve a similar function to titanium and therefore zirconium and/or silicon may be substituted, in part, for titanium. Tantalum, vanadium, tungsten and niobium tend to behave similarly to molybdenum and therefore may be substituted in part for molybdenum. However, as noted above, titanium must be present in a small amount and in preferred alloys molybdenum is present. Aluminum is known to increase the oxidation resistance of alloys and it would be advantageous to have it present in amounts of up to about 5%. However, it is believed that aluminum may be vulnerable to attack by liquid sodium and for that reason in preferred alloys it is limited to less than about 2% or even less than 1%. Also, the alloys can tolerate up to about 4% nickel and up to about 2% each of manganese and cobalt. The carbon level is preferably no higher than about 0.2% and preferably it is less than about 0.1%.

To achieve suitable structure for high strength without sacrificing fabricability the alloys of this invention are preferably prepared by a technique utilizing high energy milling such as the mechanical alloying technique, which is described in detail in U.S. Pat. Nos. 3,591,362, 3,660,049 and 3,837,930. For example, Benjamin U.S. Pat. No. 3,591,362, which is incorporated herein by reference, a method is disclosed for producing a wrought composite metal powder comprised of a plurality of consituents mechanically alloyed together, at least one of which is a metal capable of being compressively deformed such that substantially each of the particles is characterized metallographically by an internal structure comprised of the starting constituents intimately united together and identifiably mutually interdispersed. One embodiment of a method for producing the composite powder resides in providing a dry charge attritive elements and a powder mass comprising a plurality of constituents, at least one of which is a metal which is capable of being compressively deformed. The charge is subjected to agitation milling under high energy conditions in which a substantial portion of cross section of the charge is maintained kinetically in a highly activated state of relative motion and the milling continued to produce wrought composite metal powder particles of substantially the same composition as the starting mixture characterized metallographically by an internal structure in which the constituents are identifiable and substantially mutually interdispersed within substantially each of the particles. The internal uniformity of the particles is dependent on the milling time employed. By using suitable milling times, the interparticle spacing of the constituents within the particles can be made very small so that when the particles are heated to an elevated diffusion temperature, interdiffusion of diffusible constituents making up the matrix of the paticle is effected quite rapidly.

The mechanical alloying process may be conducted in a variety of equipment, including a stirred ball mill, shaker mill, vibratory ball mill, planetary ball mill, and even certain ball mills provided attention is had to the ball-to-powder ratio of the charge and size of the mill as taught by the above Benjamin patent. Preferably, the process is effected to an atmosphere which will avoid formation of oxides or nitrides.

One type of stirred ball mill attritor found to be particularly advantageous for carrying out the Benjamin invention comprises an axially vertical stationary cylinder or tank having a rotatable agitator shaft located coaxially of the mill with spaced agitator arms extending substantially horizontally from the shaft, such a mill being described in Szegvari U.S. Pat. No. 2,764,359 and in Perry's Chemical Engineer's Handbook, Fourth Edition, 1963, at pages 8 to 26. The mill contains attritive elements, e.g. balls, sufficient to bury at least some of the arms, so that, when the shaft is rotated, the ball charge, by virtue of the agitating arms passing through it, is maintained in continual state of unrest or relative motion throughout the bulk thereof. The mill can be water cooled by means of a jacket about the tank.

The foregoing method enables the production of metal systems in which insoluble non-metallics such as refractory oxides, carbides, nitrides, silicides, and the like, can be uniformly dispersed throughout the metal particle. In addition, it is possible to interdisperse alloying ingredients within the particle, particularly large amounts of alloying ingredients, e.g. such as chromium, which have a propensity to oxidize easily due to their rather high free energy of formation of the metal oxide. In this connection, mechanically alloyed powder particles can be produced by the foregoing method containing any of the metals normally difficult to alloy with another metal.

The ferritic alloy powder which consists essentially of iron-chromium-titanium(± molybdenum)-yttria, produced by the mechanical alloying process is a wrought, dispersion-strengthened heat-resistant alloy product characterized by a highly uniform internal composition and structure.

Generally speaking, in accordance with this invention, the alloy powders are consolidated as follows: the powders are canned (packed in a container which may be mild steel, stainless steel, nickel, etc.), said can then being welded shut, the can containing the powders is then extruded at an elevated temperature preferably in the range of 1700°-2200° F (ca. 926°-1205° C) at an extrusion ratio of about 3:1 to 50:1 or higher. Following extrusion, the canning material is removed by acid leaching or machining. The consolidated powders which are now in the form of a wrought bar are then further consolidated by, e.g., hot rolling between about 1500° and 2200° F (ca. 815° and 1205° C) with 25-90% reduction in area. Following the hot rolling the product is then cold worked (rolled, drawn, swaged, etc.) preferably 25-85% reduction in area to the final shape. The cold worked product is annealed at a temperature below its recrystallization temperature. The recrystallization temperature is generally in the range 1800°-2200° F (ca. 980°-1205° C). Annealing above the recrystallization temperature is not desirable since this leads to a significant loss in stress rupture strength at about 1200° F (ca. 650° C).

The resultant consolidated products possess a combination of strength and fabricability that is superior to ferritic alloys previously proposed for LMFB reactors. The alloy is particularly suitable as fuel cladding, wrapper tubes and other structural components in such reactors.

The invention will be better understood by reference to the following illustrative examples.

EXAMPLE 1

To produce a ferritic dispersion-strengthened alloy composed of iron, chromium, titanium, molybdenum, and yttria the following materials are employed: a commercially available atomized iron powder of about minus 80 mesh, a low carbon ferrochrome powder of about minus 80 mesh containing about 75% chromium and the balance essentially iron, a ferrotitanium powder of about minus 40 mesh containing about 70% titanium and the balance essentially iron, a molybdenum powder of about minus 80 mesh and yttria of about 150 Angstroms average size. The powders are used in a proportion to give a nominal composition, by weight, of 14% Cr, 1% Ti, 0.3% Mo, 0.25% yttria and the balance essentially iron.

A 4,500 gram batch proportioned to yield the foregoing composition is placed in a Szegvari 4S attritor mill. The batch is dry milled in an essentially pure argon atmosphere for 24 hours at 288 r.p.m. using a ball-to-powder ratio of 20 to 1. After attrition, the mechanically alloyed powder is sealed in a mild steel can and extruded at 1950° F (ca. 1065° C). An extrusion ratio of 6 to 1 is used at a speed of approximately 2 inches/sec. Following extrusion the alloy is decanned and hot rolled to ⅛ inch thick plate at 1950° F (ca. 1065° C), which corresponds to approximately 75% reduction in area. The plate is then cold rolled to approximately 0.060 inch thick sheet. Thereafter the sheet is annealed at a temperature of about 2000° F (ca. 1090° C), and the ultimate tensile strength (U.T.S.) and stress rupture properties determined at 1200° F (ca. 650° C). Analysis of the composition and results of the tests are tabulated in TABLE I together, for comparison, with the results of a stress rupture test similarly performed on a typical sample of 316 stainless steel.

TABLE I

| | Tests at 650° C | | |
|---|---|---|---|
| | U.T.S. | Stress-Rupture Life | |
| Sample | (KSI) | (KSI) | (hrs.) |
| Fe-14Cr-0.9Ti-0.3Mo-0.25$Y_2O_3$ | 66.3 | 50 | 16 |
| | | 47.5 | >72 |
| 316 Stainless Steel | 54 | 32 | 94 |

The high 1200° F (650° C) stress rupture life of the ferritic dispersion-strengthened alloy of this invention demonstrates its high level of strength at the operating temperature level of LMFB reactors. TABLE I also shows that the alloy of this invention compares favorably with 316 stainless steel with regard to ultimate tensile strength at 650° C.

The room temperature bend angle of 316 stainless steel is typically about 180° about a diameter equal to twice the sheet thickness. The bend angle of the alloy prepared in accordance with this example is also 180°. This demonstrates the fabricability of the alloy of this invention.

EXAMPLE 2

A series of alloys are prepared in the manner described in Example 1, except that the powders charged to the attritor are proportioned to give the compositions shown below. To provide the aluminum content, ferroaluminum powder is used, to provide silicon, a ferrosilicon powder is used, and to provide molybdenum elemental molybdenum powder is used. The alloys are annealed at 2000° F (ca. 1090° C). The composition, bend fabricability and stress rupture properties of these alloys are given below in TABLE II.

TABLE II

| Composition | Room Temperature bend angle (D=2t)* | Stress Rupture at 65° C Stress (ksi) | Life (hrs) |
|---|---|---|---|
| Fe-14.9Cr-0.2$Y_2O_3$ | 48° | 20 | 3 |
| Fe-14.1Cr-0.8Ti-0.2$Y_2O_3$ | 115° | 44.5 | 4 |
| Fe-14.2Cr-1.0Si-0.2$Y_2O_3$ | 53.5° | 37.5 | 21 |
| Fe-14.4Cr-0.8Al-0.2$Y_2O_3$ | 86° | 35 | 0.5 |

*diameter = twice thickness

The results demonstrate that the addition of 0.8%Ti to an Fe-Cr-$Y_2O_3$ base composition improves the room temperature bend angle and the stress rupture properties at 650° C. Furthermore, the addition of 0.8%Ti to the Fe-Cr-$Y_2O_3$ base composition was more effective in improving the bend angle and stress rupture properties than additions of either 1.0%Si or 0.8%Al.

EXAMPLE 3

In order to determine the effect of an increasing titanium content, two additional alloys were prepared. The preparation and processing of these alloys was substantially the same as in Example 1, except the proportion of ferrotitanium was adjusted to give the compositions with higher titanium levels. Compositions and room temperature bend angle and stress rupture properties at 650° C are given in TABLE III.

TABLE III

| Composition | Room Temperature Bend Angle (D=2t) | Stress Rupture at 650° C Stress (ksi) | Life (hrs) |
|---|---|---|---|
| Fe-14.1Cr-0.8Ti-0.20$Y_2O_3$ | 115° | 44.5 | 4 |
| Fe-13.7Cr-2.0Ti-0.25$Y_2O_3$ | 90° | 47.5 | 19 |
| Fe-13.9Cr-3.3Ti-0.25$Y_2O_3$ | 76° | 42.5 | 2 |

The results show an increase in titanium content leads to a decrease in the room temperature fabricability as measured by the bend angle. Increasing the titanium content from 0.8 to 2.0 percent provides a moderate increase in the stress rupture properties at 650° C. However, the data indicates that further additions of titanium to the 3.3 percent gives a decrease in the stress rupture strength.

EXAMPLE 4

This example demonstrates the effect of increasing molybdenum content in a nominal base composition of Fe-14Cr-1Ti-0.25$Y_2O_3$ The preparation and processing of the alloys are substantially the same as in Example 1, except the proportion of elemental molybdenum powder is adjusted to give various amounts of molybdenum. Compositions, bend angle and stress rupture tests are reported in TABLE V.

TABLE IV

| Composition | Room Temperature Bend Angle (D=2t) | Stress Rupture at 650° C Stress (ksi) | Life (hrs) |
|---|---|---|---|
| Fe-14.1Cr-0.8Ti-0.20$Y_2O_3$ | 115° | 44.5 | 4 |
| Fe-14.0Cr-0.9Ti-0.3Mo-0.25$Y_2O_3$ | 180° | 50 | 16 |
| Fe-13.8Cr-1.0Ti-1.2Mo-0.25$Y_2O_3$ | 70° | 50 | 2 |
| Fe-13.5Cr-1.1Ti-1.9Mo-0.25$Y_2O_3$ | 140° | 50 | 14 |

The results show an increase in the room temperature bend angle and the 650° C stress rupture properties are obtained by adding 0.3 percent molybdenum. Further additions of molybdenum up to 1.9 percent give essentially the same stress rupture properties as the 0.3 percent molybdenum level. The room temperature bend angle shows an inconsistent behavior for additions of molybdenum above the 0.3 percent level. An additional alloy with a nominal composition of Fe-14Cr-5Ti-2Mo-0.25$Y_2O_3$ was prepared by attritor processing as in Example 1. Although this alloy was successfully extruded and hot rolled as in Example 1, it could not be cold rolled. Severe cracking occurred during the cold rolling indicating poor ductility.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. As a powder metallurgy article of manufacture, a structural element of a LMFB reactor comprising a wrought dispersion-strengthened, heat resistant ferritic alloy having a composition consisting essentially of, by weight, about 13% to about 25% chromium, about 0.2% to less than 2% titanium, up to about 2% molybdenum, up to about 2% aluminum, a small but effective amount for improved strength up to about 1.5% yttria and the balance, except for incidental elements and impurities, essentially iron, said wrought ferritic element being characterized substantially throughout by composition uniformity and by a high degree of dispersion uniformity.

2. An article of manufacture according to claim 1, wherein molybdenum is present in a small but effective amount for improved strength up to less than about 1%.

3. An article of manufacture according to claim 1, wherein the chromium content is about 13% up to about 20%.

4. An article of manufacture according to claim 2, wherein the maximum titanium content is about 1.5%.

5. An article of manufacture according to claim 2, wherein the chromium is about 13% up to less than about 16% and the titanium content is about 0.5% to about 1%.

6. An article of manufacture according to claim 5, wherein the yttria content is less than about 0.75%.

7. An article of manufacture according to claim 1, wherein the alloy is characterized by a 100 hour stress rupture life of at least 40 ksi at 650° C.

8. An article of manufacture according to claim 1, wherein the alloy contains less than 1% aluminum.

9. A structural element of a nuclear reactor comprising a wrought dispersion-strengthened, heat resistant ferritic alloy having a composition consisting essentially of, by weight, about 13% up to less than about 16% chromium, about 0.2% to about 1.5% titanium, up to about 1% Mo, a small but effective amount for improved strength up to about 0.75% of a refractory stable compound selected from the group metal oxide, metal nitride and metal carbide, and the balance, except for incidental elements and impurities, essentially iron, said element being prepared as a powder metallurgy product by the steps comprising a) mechanically alloying a mixture of fine powder containing components of said alloy in amounts proportional to give said composition, b) consolidating the resultant mechanically alloyed powder and effecting at least 25% reduction in area; thereby producing a dispersion-strengthened heat resistant ferritic alloy having a 100-hour stress-rupture life at 650° C of at least 40 ksi.

10. A structural element of a nuclear reactor according to claim 9, wherein the consolidated product is annealed at a temperature below the recrystallization temperature of the alloy.

11. A structural element of a nuclear reactor according to claim 9, wherein the dispersoid is selected from the group consisting of yttria, thoria, ceria, and rare earth oxides.

12. A structural element of a nuclear reactor according to claim 11, wherein the titanium content is less than about 1%, and wherein the dispersoid comprises ytrria, the yttria content being less than about 0.5%.

13. A structural element of a nuclear reactor according to claim 12, wherein the molybdenum content is about 0.1% to about 0.5%.

14. A mechanically alloyed ferritic dispersion-strengthened heat resistant alloy used as a structural element of a LMFB reactor consisting essentially of, by weight, about 13% to about 25% chromium, about 0.2% up to less than 2% titanium, up to about 2% molybdenum, less than about 1% aluminum, a small but effective amount for improved strength up to about 1.5% yttria and the balance, except for incidental elements and impurities, essentially iron, said wrought ferritic element being characterized substantially throughout by composition uniformity and by a high degree of dispersion uniformity.

15. A mechanically alloyed ferritic dispersion-strengthened heat resistant alloy used as a structural element of a LMFB reactor according to claim 14, wherein the chromium content is about 13% up to less than about 16%, the titanium content is about 0.5% up to about 1%, the molybdenum content is up to about 1%, and the yttria content is less than about 0.5%.

16. As a powder metallurgy article of manufacture, a structural element of a LMFB reactor comprising a wrought dispersion-strengthened, heat resistant ferritic alloy having a composition consisting essentially of, by weight, about 13% to about 25% chromium, about 0.2% to less than 2% titanium, up to about 2% molybdenum, up to about 2% aluminum, up to about 2% each of zirconium, silicon, vanadium, tungsten, niobium, and manganese, and up to about 4% nickel, provided that the level of the elements zirconium, silicon, vanadium, tungsten, niobium, manganese and nickel is such that it is below that which in combination with the titanium level will effect a precipitation hardening phase in the alloy, a small but effective amount for improved strength up to about 1.5% yttria and the balance, except for incidental elements and impurities, essentially iron, said wrought ferritic element being characterized substantially throughout by composition uniformity and by a high degree of dispersion uniformity.

17. An article of manufacture according to claim 1, wherein the alloy is characterized in that it is in a non-recrystallized, hot-worked, cold-worked condition.

* * * * *